US006025320A

United States Patent [19]

Appel et al.

[11] Patent Number: 6,025,320

[45] Date of Patent: Feb. 15, 2000

[54] DETERGENT COMPOSITIONS AND PROCESS FOR PREPARING THEM

[75] Inventors: Peter Willem Appel, Rotterdam; François Delwel, Dordrecht; Johan Christiaan Klein-Velderman, Rotterdam, all of Netherlands

[73] Assignee: Lever Brothers Company, New York, N.Y.

[21] Appl. No.: 09/258,867

[22] Filed: Feb. 26, 1999

Related U.S. Application Data

[63] Continuation of application No. 08/705,383, Aug. 29, 1996.

[30] Foreign Application Priority Data

Sep. 4, 1995 [GB] United Kingdom ..... 9518015
Nov. 9, 1995 [GB] United Kingdom ..... 9522993

[51] Int. Cl.[7] ..... C11D 11/00; C11D 3/37

[52] U.S. Cl. ..... 510/444; 510/356; 510/361; 510/476; 510/477; 264/117; 264/140

[58] Field of Search ..... 510/444, 361, 510/356, 477, 476; 264/117, 140

[56] References Cited

U.S. PATENT DOCUMENTS

| | | | |
|---|---|---|---|
| 3,557,039 | 1/1971 | McIntyre et al. | 260/29.2 |
| 4,076,643 | 2/1978 | Brahm et al. | 252/89 R |
| 4,400,288 | 8/1983 | Dhanani et al. | 510/347 |
| 4,444,561 | 4/1984 | Denzinger et al. | 8/137 |
| 4,746,456 | 5/1988 | Kud et al. | 252/174.24 |
| 4,849,126 | 7/1989 | Kud et al. | 252/174.23 |
| 5,034,147 | 7/1991 | Ramachandran | 510/298 |
| 5,318,733 | 6/1994 | Carduck et al. | 264/15 |
| 5,399,287 | 3/1995 | Pichler et al. | 510/532 |
| 5,451,354 | 9/1995 | Aouad et al. | 264/117 |
| 5,490,954 | 2/1996 | Van Der Hoeven et al. | 510/444 |
| 5,540,855 | 7/1996 | Baillely et al. | 510/276 |
| 5,610,131 | 3/1997 | Donoghue et al. | 510/444 |
| 5,614,485 | 3/1997 | Painter | 510/444 |
| 5,670,468 | 9/1997 | Moens | 510/226 |

FOREIGN PATENT DOCUMENTS

| | | |
|---|---|---|
| 294967/95 | 7/1995 | Australia . |
| 0 001 305 | 4/1979 | European Pat. Off. . |
| 219 048 | 4/1987 | European Pat. Off. . |
| 219 328 | 4/1987 | European Pat. Off. . |
| 340 013 | 11/1989 | European Pat. Off. . |
| 358 472 | 3/1990 | European Pat. Off. . |
| 358 473 | 3/1990 | European Pat. Off. . |
| 358 474 | 3/1990 | European Pat. Off. . |
| 367 339 | 5/1990 | European Pat. Off. . |
| 384 070 | 8/1990 | European Pat. Off. . |
| 402 112 | 12/1990 | European Pat. Off. . |
| 420 317 | 4/1991 | European Pat. Off. . |
| 421 664 | 4/1991 | European Pat. Off. . |
| 506 184 | 9/1992 | European Pat. Off. . |
| 544 492 | 6/1993 | European Pat. Off. . |
| 622 454 | 11/1994 | European Pat. Off. . |
| 694 608 | 1/1996 | European Pat. Off. . |
| 1 467 098 | 3/1977 | United Kingdom . |
| 95/05445 | 2/1995 | WIPO . |
| 95/07968 | 3/1995 | WIPO . |
| 95/10595 | 4/1995 | WIPO . |
| 95/12659 | 5/1995 | WIPO . |
| 95/22593 | 8/1995 | WIPO . |

OTHER PUBLICATIONS

M. Floor et al., "Structural and conformational effects on the complexation of calcium by 2.3–dicarboxy derivatives of β–cyclodextrin (cyclomaltoheptaose), amylose, and cellulose", Carbohydrate Research, vol. 203, pp. 19–32, Elsevier Science Publishers B.V., 1990.

*Primary Examiner*—Lorna M. Douyon
*Attorney, Agent, or Firm*—Rimma Mitelman

[57] ABSTRACT

A non-spray-dried particulate detergent composition or component having a bulk density of at least 600 g/liter, prepared by mixing and granulating liquid and solid ingredients in a high-speed mixer/granulator, contains a builder polymer and/or a soil-release polymer. The polymer is incorporated during the mixing and granulation process in the form of a non-aqueous premix with a non-aqueous diluent.

7 Claims, No Drawings

DETERGENT COMPOSITIONS AND PROCESS FOR PREPARING THEM

This is a continuation of Ser. No. 08/705,383 filed Aug. 29, 1996.

TECHNICAL AREA

The present invention relates to the preparation of non-spray-dried particulate detergent compositions or components of high bulk density, and particularly compositions of low moisture content, containing detergent-functional polymers.

BACKGROUND AND PRIOR ART

The incorporation of a variety of polymers in particulate detergent compositions for a variety of reasons is well-known. Polymers may be incorporated, in particular, as builders and sequestrants, and as soil release agents. Examples of builder polymers include polycarboxylates, for example, acrylate and acrylate/maleate polymers; examples of soil release polymers include polyethylene glycol/polyvinyl acetate graft copolymers, and soil release polyesters derived from terephthalic acid and polyethylene glycol.

Detergent-functional polymers for incorporation into detergent powders are generally supplied as aqueous solutions of various concentrations. In the aqueous solutions, the water has no function other than lowering the viscosity during and after the polymerisation process. If it is surplus to the requirements of the final detergent product, it must be removed by the detergent manufacturer either before or during its incorporation into products.

Traditional low- and medium-density detergent powders were and are prepared by spray-drying an aqueous slurry of all ingredients that are sufficiently heat-insensitive, including most detergent-functional polymers. This is a high temperature process in which large amounts of water are driven off. In this process the water associated with the polymer is a minor contributor to the total slurry moisture and makes little or no difference to the efficiency or energy consumption of the process.

The compact or concentrated powders which now form a substantial part of the market, however, are prepared by non-tower mixing and granulation processes which generally avoid high-temperature processing where water will be driven off.

In such processes it is generally desirable that the moisture content should be kept as low as possible, both to facilitate granulation, which requires a carefully controlled balance of liquid and solid ingredients, and to ensure that the final product also has as low as possible a moisture content. Low moisture content is especially important for compositions to which moisture-sensitive bleach ingredients, especially sodium percarbonate, are to be added.

Mixing and granulation may be followed by a separate drying step, for example, in a fluidised bed, but that requires additional plant and the expenditure of additional energy.

Accordingly, in the preparation of compact high bulk density powders, the incorporation of polymers in the form of aqueous solutions is not ideal. Only small amounts can be used before processing behaviour is affected detrimentally; and the resulting powders have also been found to leave residues on washloads.

Simply drying the aqueous polymer solution itself, in an attempt to obtain a dry 100% polymer material, is not an option for most polymers because it results in a gel, a sticky or rubbery mass or a hygroscopic material which is difficult or impossible to handle. The drying itself is also difficult and energy-intensive.

A possible alternative approach is to dry the aqueous polymer solution in combination with other materials, notably inorganic or organic salts, but this method too has encountered problems. The use of soluble salts can lead to salting-out of the polymer in rubbery lumps and balls, while inorganic salts such as zeolite give products which are very slow to disintegrate and dissolve in the wash; this route tends to produce only materials with low levels of polymer (10 wt % or below); and again an energy-intensive drying step is needed.

It has now been found that detergent-functional polymers may be easily and successfully incorporated in particulate detergent compositions or components in the form of a non-aqueous liquid premix, that is to say, a premix produced by a process in which a non-aqueous diluent has been used instead of water to reduce the viscosity of the polymer during the polymerisation process.

EP 622 454A (Procter & Gamble) discloses structured pumpable nonionic surfactant premixes containing, as structuring agents, certain polymers derived from hydroxyl-group-containing monomers, or polyvinyl pyrrolidone or polyvinyl pyridine-N-oxide, or sugars or artificial sweeteners. The premixes may contain substantial quantities of water. The premixes are used in the preparation of granular laundry detergent compositions components of high bulk density containing nonionic surfactants.

DEFINITION OF THE INVENTION

The present invention accordingly provides a process for the preparation by a non-spray-drying process of a particulate detergent composition or component having a bulk density of at least 600 g/liter and including a builder polymer and/or a soil-release polymer, which process includes the step of mixing and granulating liquid and solid ingredients in a high-speed mixer/granulator, wherein the polymer is incorporated in the composition by including as a liquid ingredient in the mixing and granulation step a non-aqueous premix of the polymer with a non-aqueous diluent.

The invention further provides a particulate detergent composition or component having a bulk density of at least 600 g/liter and containing a builder polymer and/or a soil release polymer, prepared by a process as defined in the previous paragraph.

The invention further provides the use of a non-aqueous premix of a builder polymer and/or a soil-release polymer with a non-aqueous diluent in the preparation by mixing and granulation in a high-speed mixer/granulator of a particulate non-spray-dried detergent composition having a bulk density of at least 600 g/liter and containing a builder polymer and/or a soil release polymer.

The invention is of especial applicability to detergent compositions having a relative humidity value at 1 atmosphere and 20° C. not exceeding 30%.

DETAILED DESCRIPTION OF THE INVENTION

The Builder or Soil-release Polymer

Polymers used as builders and sequestrants, and also as powder structurants, are above all polycarboxylate polymers. Preferred polycarboxylate polymers are efficient binders of calcium ions, preferably having a $pK_{Ca}2+$ of at least 5.5, as measured with a calcium-sensitive electrode, for example, as described by M Floor et al, Carbohydrate Research 203 (1990) pages 19 to 32.

These materials are polymers of unsaturated monocarboxylic acids and/or unsaturated dicarboxylic acids. Suitable monocarboxylic monomers include acrylic, methacrylic, vinylacetic, and crotonic acids; suitable dicarboxylic monomers include maleic, fumaric, itaconic, mesaconic and citraconic acids and their anhydrides. The polymers may also contain units derived from non-carboxylic monomers, preferably in minor amounts. The polymers may be in acid, salt or partially neutralised form.

Especially preferred are copolymers of acrylic and maleic acids, for example, Sokalan (Trade Mark) CP5 (salt form) and CP45 (partially neutralised form)(70% acrylic, 30% maleic) and CP7 (50% acrylic, 50% maleic). Other suitable polymers are homopolymers of acrylic acid, for example, Sokalan (Trade Mark) PA40; polymers of maleic acid with methyl vinyl ether, for example, Sokalan (Trade Mark) CP2; and polymers of acrylic acid with olefin, for example, Sokalan (Trade Mark) CP9.

A preferred soil release polymer for use in the granular adjunct and detergent compositions of the present invention is a graft copolymer in which polyvinyl acetate and/or hydrolysed polyvinyl acetate (polyvinyl alcohol) groups are grafted onto a polyalkylene oxide (preferably polyethylene oxide) backbone.

Polymers of this type are described and claimed in EP 219 048B (BASF). These polymers are obtainable by grafting a polyalkylene oxide of molecular weight (number average) 2000–100 000 with vinyl acetate, which may be hydrolysed to an extent of up to 15%, in a weight ratio of polyalkylene oxide to vinyl acetate of 1:0.2 to 1:10. The polyalkylene oxide may contain units of ethylene oxide, propylene oxide and/or butylene oxide; polyethylene oxide is preferred.

Preferably the polyalkylene oxide has a number-average molecular weight of from 4000 to 50 000, and the weight ratio of polyalkylene oxide to vinyl acetate is from 1:0.5 to 1:6. Especially preferred are polymers derived from polyethylene oxide of molecular weight 2000–50000 and having a weight ratio of polyethylene oxide to vinyl acetate of from 1:0.5 to 1:6.

A material within this definition, based on polyethylene oxide of molecular weight 6000 (equivalent to 136 ethylene oxide units), containing approximately 3 parts by weight of vinyl acetate units per 1 part by weight of polyethylene oxide, and having itself a molecular weight of 24 000, is commercially available from BASF as Sokalan (Trade Mark) HP22.

Other soil release polymers which may be incorporated by the process of the present invention include polyesters based on aromatic dicarboxylic acids, for example, terephthalic acid, and polyethylene glycol.

Examples of the so-called PET/POET (polyethylene terephthalate/polyoxyethylene terephthalate) polymers are disclosed in U.S. Pat. No. 3,557,039 (ICI), GB 1 467 098 and EP 1305A (Procter & Gamble). Polymers of this type are available commercially, for example, as Permalose, Aquaperle and Milease (Trade Marks) (ICI) and Repel-O-Tex (Trade Mark) SRP3 (Rhône-Poulenc).

The polymer may suitably be present in the detergent composition in an amount of from 0.1 to 20 wt %, preferably from 0.5 to 10 wt %.

The Non-aqueous Diluent

The non-aqueous diluent may be any material compatible with the polymer and with other detergent ingredients, and capable of forming a substantially homogeneous premix with the polymer that is a mobile liquid at normal processing temperatures. However, preferably the diluent is a material is one which itself has detergent functionality.

Most preferably the non-aqueous diluent comprises a nonionic surfactant, desirably an ethoxylated nonionic surfactant.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol.

The Non-aqueous Premix

The non-aqueous premix used in the process of the invention is substantially 100 wt % water free. It consists essentially of the builder or soil-release polymer and a non-aqueous diluent, and is in the form of a liquid, preferably a homogeneous liquid, mobile at normal processing temperatures. The premix may also be mobile at ambient temperature, but that is not essential.

Preferably the premix contains at least 15 wt %, more preferably from 20 to 90 wt % of polymer. Preferably the premix contains at least 30 wt %, more preferably at least 40 wt %, of polymer. Concentrated premixes containing more than 50 wt % of polymer are of especial interest.

An example of a suitable premix is Sokalan (Trade Mark) HP23 ex BASF, which is a mixture of 60 wt % of the soil release polymer Sokalan HP22 (polyvinyl acetate/polyethylene glycol graft copolymer) mentioned above, and 40 wt % of ethoxylated nonionic surfactant ($C_{12-14}$ alcohol ethoxylated with an average of 7 ethylene oxide units per mole of alcohol: Lutensol (Trade Mark) A7N).

The Particulate Detergent Composition or Component

The detergent composition or component prepared by the process of the invention is a non-spray-dried granular or particulate material of high bulk density: at least 600 g/liter, preferably at least 650 g/liter and more preferably at least 700 g/liter.

The detergent composition or component prepared in accordance with the invention is also preferably characterised by a low moisture content, which may be expressed as a relative humidity value at 1 atmosphere and 20° C. not exceeding 30%. The term "relative humidity value" as used herein means the relative humidity of air in equilibrium with the composition: it is an indirect measurement of the water activity in a solid. It is the ratio of the current water concentration in the air (kg water/kg air) to the maximum at a given temperature and pressure, expressed as a percentage of the value for saturated air. For a solid an equilibrium is established between the water in the solid and the atmosphere, and the measured relative humidity is a characteristic for that solid at a given temperature and pressure. All relative humidity values quoted in the present specification are normalised to 1 atmosphere pressure and 20° C.

Preferred detergent compositions of the invention have a relative humidity value not exceeding 25%, and especially preferred compositions have a relative humidity value not exceeding 20%.

Typically detergent compositions of high bulk density comprise a homogeneous base powder, prepared by mixing and granulation, in which all sufficiently robust ingredients are incorporated, and, optionally, separate admixed (postdosed) granules or adjuncts comprising other ingredients unsuitable for incorporation into the base powder, or deliberately omitted from it. The final product may consist only of the homogeneous base powder, but generally postdosed performance ingredients unsuitable for incorporation in the base powder are also present. In that case the base powder is generally the predominant constituent of the final product and may for example amount to 40–90 wt % of it.

The process of the present invention is especially suitable for incorporating builder and soil-release polymers into the base powder of such a detergent composition. It may also be used to prepare granular adjuncts, when polymers are to be incorporated by means of postdosed adjuncts rather than via the base powder, as described, for example, in EP 421 664A (Rohm and Haas), and as described and claimed in our copending British Patent Application No. 95 18015.4 (Case C3675) filed on Sep. 4, 1995. Such adjuncts typically comprise the polymer absorbed or adsorbed in or on an inorganic carrier material.

While a detergent base powder prepared according to the invention preferably has a relative humidity value not exceeding 30%, and more preferably not exceeding 20%, higher values may be tolerated for adjuncts which are intended for postdosing, in minor quantities, to a base powder of low moisture content. Therefore, adjuncts according to the invention may suitably have a relative humidity value not exceeding 50%, preferably not exceeding 40% and more preferably not exceeding 30%.

The Detergent Base Powder

A particulate detergent base powder that may be prepared by the process of the invention contains as essential ingredients detergent surfactants (detergent-active compounds) and detergency builders, a builder or soil-release polymer, and, as indicated above, may contain other ingredients customary in laundry detergents.

The detergent-active compounds may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

A preferred surfactant system comprises one or more anionic sulphonate or sulphate type surfactants, in combination with one or more nonionic surfactants, optionally in conjunction with a minor amount of soap. Especially preferred surfactant systems comprise alkylbenzene sulphonate and/or primary alcohol sulphate in combination with ethoxylated alcohol nonionic surfactant.

The total amount of surfactant present may suitably range from 5 to 50 wt % (based on the whole product including postdosed ingredients), preferably from 10 to 30 wt % and more preferably from 15 to 25 wt %.

The base powder also contains one or more detergency builders. Additional builder may if desired be postdosed. The total amount of detergency builder in the composition will suitably range from 10 to 90 wt %, preferably from 10 to 60 wt %.

The builder system preferably consists wholly or partially of an alkali metal aluminosilicate. This is suitably present in an amount of from 10 to 80 wt % (based on the anhydrous material), preferably from 10 to 60% by weight and more preferably from 25 to 50 wt %.

The preferred alkali metal aluminosilicates (zeolites) are crystalline alkali metal aluminosilicates having the general formula:

$$0.8\text{–}1.5Na_2O.Al_2O_3.0.8\text{–}6SiO_2$$

These materials also contain some bound water. Preferred sodium aluminosilicates contain 1.5–3.5 $SiO_2$ units (in the formula above).

The zeolite may be the commercially available zeolite 4A now widely used in laundry detergent powders. However, advantageously, the zeolite present in the adjuncts of the invention may be maximum aluminium zeolite P (zeolite MAP) as described and claimed in EP 384 070A (Unilever). Zeolite MAP is defined as an alkali metal aluminosilicate of the zeolite P type having a silicon to aluminium ratio not exceeding 1.33, preferably not exceeding 1.15, more preferably not exceeding 1.07, most preferably about 1.00.

Supplementary builders may also be present in the base powder. As indicated above, polycarboxylate polymers are preferred supplementary builders. Other organic supplementary builders include monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts. Especially preferred organic builders are citrates, suitably used in amounts of from 5 to 30 wt %, preferably from 10 to 25 wt %.

Builders, both inorganic and organic, are preferably present in alkali metal salt, especially sodium salt, form.

Particulate detergent compositions may contain alkali metal, preferably sodium, carbonate, in order to increase detergency and ease processing. Sodium carbonate may suitably be present in amounts ranging from 1 to 60 wt %, preferably from 2 to 40 wt %, and may be incorporated in the base powder, postdosed as separate particles or granules, or both, as well as possibly present in polymer adjunct granules.

The base powder may incorporate a small amount of a powder structurant, for example, a fatty acid (or fatty acid soap), a sugar, or sodium silicate. As previously indicated, the presence of a polycarboxylate builder polymer in the base powder aids powder structuring. Another preferred powder structurant is fatty acid soap, suitably present in an amount of from 1 to 5 wt %.

Other ingredients that may be present in the detergent base powder include fluorescers, inorganic salts, cellulosic antiredeposition agents, and water.

As previously indicated, the detergent base powder of the invention preferably has a relative humidity value at 1 atmosphere and 20° C. not exceeding 30%, more preferably not exceeding 20%.

Polymer Adjuncts

In a second embodiment of the invention the process of the invention may be used to prepare adjuncts in which a builder polymer and/or a soil release polymer is or are carried on an inorganic carrier material.

The polymer preferably constitutes from 5 to 30 wt %, more preferably from 15 to 25 wt %, of the granular adjunct.

The inorganic carrier material, which preferably constitutes from 50 to 75 wt % of the granular adjunct, is chosen to provide the best combination of high carrying capacity with good disintegration and dispersion and/or dissolution characteristics. Suitable inorganic salts include sodium carbonate, sodium sulphate, and sodium aluminosilicate (zeolite).

An especially preferred carrier material comprises sodium carbonate and/or sodium bicarbonate in combination with zeolite. The zeolite suitably constitutes from 35 to 60 wt % of the granular adjunct, while the carbonate-based salt suitably constitutes from 15 to 30 wt %. The ratio of zeolite to carbonate-based salt may vary, for example, from 0.5:1 to 9:1, and for the optimum balance between carrying capacity and dissolution is preferably from 1:1 to 3:1. Preferred zeolites are discussed above in the context of detergency builders; zeolite MAP is especially preferred.

Preparation of an adjunct by the process of the invention of course results in the adjunct containing the non-aqueous diluent. It is therefore especially preferred in this embodiment of the invention that the diluent should itself be a detergent-functional material, and ethoxylated nonionic surfactants are especially preferred. Ethoxylated nonionic surfactant is suitably present in an amount of up to 20 wt %, preferably from 2 to 15 wt %, based on the adjunct.

A preferred adjunct composition is as follows:

(a) from 5 to 30 wt % of builder and/or soil release polymer,
(b) from 10 to 30 wt % of ethoxylated nonionic surfactant,
(c) from 15 to 30 wt % of sodium carbonate and/or sodium bicarbonate,
(d) from 35 to 60 wt % of zeolite,
(e) water to 100 wt %.

The adjunct granules preferably have an average particle size of at least 300 $\mu$m and more preferably at least 400 $\mu$m. Most preferably the adjunct granules have an average particle size within the range of from 400 to 800 $\mu$m.

As previously indicated, adjuncts in accordance with the invention preferably have a low moisture content, for example a relative humidity value of less than 50%. Values of 30% and below are desirable but are not essential when the adjunct is to be postdosed to a base powder having a very low moisture content.

Other Postdosed Ingredients

Detergent compositions containing base powders and/or adjuncts prepared by the process of the invention may also contain other postdosed ingredients.

Heavy duty compositions will contain bleach ingredients, which are invariably postdosed. A preferred bleach system comprises a peroxy bleach compound, for example, an inorganic persalt or organic peroxyacid. Preferred inorganic persalts include sodium perborate monohydrate and tetrahydrate, and sodium percarbonate. The peroxy bleach compound may be used in conjunction with a bleach activator (bleach precursor), for example, N,N,N',N'-tetracetyl ethylenediamine (TAED), to improve bleaching action at low wash temperatures. A bleach stabiliser (heavy metal sequestrant) may also be present: suitable bleach stabilisers include ethylenediamine tetraacetate (EDTA) and the polyphosphonates such as ethylenediamine tetramethylene phosphonate (EDTMP) or diethylenetriamine pentamethylene phosphonate (DETPMP).

An especially preferred bleach system comprises a peroxy bleach compound, preferably sodium percarbonate, together with TAED and a polyphosphonate bleach stabiliser.

Other materials that may be present as postdosed ingredients include sodium silicate; fluorescers; inorganic salts such as sodium sulphate; foam control agents; enzymes; dyes; coloured speckles; perfumes; and fabric softeners.

A typical compact high bulk density heavy duty laundry detergent composition embodying the process of the invention may comprise:

(i) from 40 to 90 wt % of a non-spray-dried homogeneous particulate base powder having a bulk density of at least 600 g/liter, comprising from 5 to 50 wt % of one or more detergent-active compounds, from 10 to 80 wt % of a detergency builder and from 0.5 to 10 wt % of polymer (all based on the final product);
(ii) bleaching ingredients including from 5 to 35 wt % of an inorganic persalt and from 2 to 10 wt % of tetraacetylethylenediamine;
(iii) optionally, one or more postdosed polymer adjuncts, and
(iv) other ingredients, for example, enzymes, foam controllers, or inorganic salts, in the form of separate granules or adjuncts, to 100 wt %.

In such a composition the process of the invention may be used to incorporate polymer into the base powder, into a postdosed adjunct, or both.

The Process

The essential step of the process of the invention is a mixing and granulation process in a high-speed mixer/granulator having both a stirring and a disintegrating action.

The high-speed mixer/granulator, also known as a high-speed mixer/densifier, may be a batch machine such as the Fukae (Trade Mark) FS, or a continuous machine such as the Lodige (Trade Mark) Recycler CB30. Suitable machines and processes are described, for example, in EP 340 013A, EP 367 339A, EP 390 251A, EP 420 317A, EP 506 184A and EP 544 492A (Unilever).

This step may be followed by further processing in a moderate-speed mixer/granulator such as the Lödige Ploughshare, and then cooling and optionally drying in a fluidised bed.

This process is suitable both for the preparation of a detergent base powder, and for the preparation of an adjunct.

In the preparation of a fully formulated detergent composition, liquid ingredients unsuitable for incorporation in the base powder, for example, mobile ethoxylated nonionic surfactants and perfume may then be sprayed on or otherwise mixed into the base powder, and the postdosed ingredients, such as adjunct granules, bleach ingredients (bleaches, bleach precursor, bleach stabilisers), proteolytic and lipolytic enzymes, coloured speckles, perfumes, foam control granules and any other granular or particulate ingredients not included in the base powder, incorporated by dry mixing.

EXAMPLES

The invention is further illustrated by the following Examples, in which parts and percentages are by weight unless otherwise stated.

Example 1

A detergent base powder of high bulk density containing the builder/structurant acrylic/maleic copolymer Sokalan (Trade Mark) CP5 was prepared to the formulation given below.

| | Base powder composition |
|---|---|
| Na primary alcohol sulphate | 21.2 |
| Nonionic surfactants | 10.6 |
| Na soap | 3.3 |
| Zeolite MAP (anhydrous basis) | 40.1 |
| Sodium citrate | 6.3 |
| Sodium carbonate | 4.1 |
| Sodium carboxymethylcellulose | 1.4 |
| Acrylic/maleic copolymer | 4.0 |
| Minor ingredients and water | 9.0 |
| Total base powder | 100.0 |

The acrylic/maleic polymer was used in the form of a premix with ethoxylated nonionic surfactant (7EO), containing 40 wt % polymer and 60 wt % nonionic surfactant.

The base powder was prepared as follows. Solids (primary alcohol sulphate/zeolite/carbonate adjunct, zeolite, sodium carbonate, citrate) and liquids (nonionic surfactant, soap, polymer/nonionic surfactant premix) were mixed and granulated in a Eirich (Trade Mark) high-speed batch mixer granulator operated at a circumferential speed of 1.1 m/s and an impeller speed of 12 m/s. From the granulator, the granulate passed to a fluidised bed for cooling and elutriation of fine particles.

The base powder was a free-flowing and non-sticky material, having a bulk density of 720 g/liter and a relative humidity value of 28% at 20° C. and 1 atmosphere.

Comparative Example A

An attempt to prepare an identical base powder using an aqueous polymer solution (40 wt %) using the same process gave a granulate that required 2 wt % additional zeolite MAP and a drying step. Even with these measures of drying and extra zeolite, the resulting product was more sticky than the product of Example 1. Furthermore, the product had even after extensive drying a relative humidity value of over 40% at 20° C. and 1 atmosphere, which would lead to instability on storage of postdosed moisture-sensitive ingredients such as sodium percarbonate.

Examples 2 and 3

Detergent base powders of high bulk density containing the soil-release polymer Sokalan (Trade Mark) HP22 (polyvinyl acetate/polyethylene glycol graft copolymer) ex BASF were prepared to the formulations below.

| | 2 | 3 |
|---|---|---|
| Na primary alcohol sulphate | 21.4 | 20.4 |
| Nonionic surfactant | 10.8 | 10.3 |
| Na soap | 3.3 | 3.2 |
| Zeolite MAP (anhydrous basis) | | |
| in mixer/granulator | 40.1 | 41.1 |
| layered | 1.9 | 1.8 |
| Sodium citrate | 6.1 | 5.9 |
| Sodium carbonate | 4.2 | 4.0 |
| Sodium carboxymethylcellulose | 1.3 | 1.3 |
| PVA/PEG copolymer | 1.8 | 3.0 |
| Minor ingredients and water | 9.1 | 9.0 |
| TOTAL | 100.0 | 100.0 |

The soil release polymer was used in the form of a premix with ethoxylated nonionic surfactant (7EO), containing 60 wt % polymer and 40 wt % nonionic (trade name Sokalan HP23).

The base powder was prepared as follows. Solids (the major part of the zeolite MAP, primary alcohol sulphate/zeolite/carbonate adjunct, sodium carbonate, citrate) and liquids (nonionic surfactant, soap, polymer/nonionic surfactant premix) were mixed and granulated in a Lödige (Trade Mark) CB Recycler continuous high speed mixer granulator, operated at a tip speed of 24 m/s. From the Recycler the granulate passed to a Lödige Ploughshare moderate speed mixer/granulator, operated at a tip speed of 3 m/s with maximum residence time, where the remaining zeolite was added for layering. The granulate then passed to a fluidised bed for cooling and elutriation of fine particles.

Physical properties of the product ex fluidised bed were as follows:

| | 2 | 3 |
|---|---|---|
| Bulk density (g/liter) | 800 | 805 |
| Dynamic flow rate (ml/s) | 150 | 144 |
| Relative humidity value (%) | 19 | 17 |

Comparative Examples B and C

An attempt to prepare identical base powders using an aqueous polymer solution (20 wt %) using the same process gave a granulate that required 4 wt % extra zeolite MAP and a drying step for product B (comparable to Example 2), and 17 wt % extra zeolite MAP and a drying step for product C (comparable to example 3).

Even with these measures, a product containing more fines and coarse material was yielded. Furthermore, both products B and C had even after extensive drying a relative humidity value of over 40% at 20 deg C. and 1 atmosphere, which would lead to instability on storage of postdosed moisture-sensitive ingredients.

Throughputs in kg/h were as follows:

| | 4 | 5 | 6 |
|---|---|---|---|
| Sodium carbonate | — | 100 | 200 |
| Sodium bicarbonate | 200 | 100 | — |
| Zeolite MAP | | | |
| (in granule) | 360 | 425 | 425 |
| (layered) | 80 | 40 | 40 |
| Polymer/nonionic | 290 | 285 | 300 |

Physical properties were as follows:

| | 4 | 5 | 6 |
|---|---|---|---|
| Bulk density (g/liter) | | | |
| ex Ploughshare | 770–800 | 785 | |
| ex fluidised bed | 740–810 | | 790 |
| Dynamic flow rate (ml/s) | | | |
| ex Ploughshare | 85–115 | 70 | |
| ex fluidised bed | 135–145 | | 145 |
| Average particle size dp ($\mu$m) | | 540–650 | |
| Relative humidity value* (%) | 42 | 46 | 45 |

*when produced on pilot plant scale using non-conditioned air in the fluidised bed; Example 6 when repeated on main plant scale had a relative humidity value of 11%.

The adjuncts of Examples 4 to 6 could be incorporated into detergent compositions by postdosing, for example, in an amount of 4.5 wt %, to a base powder similar to that described in Examples 1 to 3 but (optionally) not containing polymer.

We claim:

1. A non-spray drying process for the preparation of a particulate detergent composition or component having a bulk density of at least 600 g/liter and including, a polymer, which process comprises a) preparing a concentrated non-aqueous premix containing more than 40 wt %, by weight of the premix, of the polymer with a non-aqueous diluent; and b) mixing and granulating liquid and solid ingredients including the non-aqueous premix in a high-speed mixer/granulator;

wherein the polymer is selected from the group consisting of: polymers and copolymers of acrylic, methacrylic, vinylacetic, crotonic, maleic, fumaric, itaconic, mesaconic and citraconic acids and their anhydrides.

2. A process as claimed in claim 1, wherein the polymer is a homo- or copolymer of acrylic, maleic or itaconic acid.

3. A process as claimed in claim 1, wherein the non-aqueous diluent comprises an ethoxylated nonionic surfactant.

4. A process as claimed in claim 1, wherein the non-aqueous premix contains more than 50 wt % of polymer.

5. A particulate non-spray-dried detergent composition or component having a bulk density of at least 600 g/liter containing a polymer, prepared by a process as claimed in claim 1, having a relative humidity value at 1 atmosphere and 20° C. not exceeding 30%.

6. A detergent composition or component as claimed in claim 5, which is a detergent base powder comprising detergent surfactants, detergency builders and the polymer.

7. A detergent composition or component as claimed in claim 5, which is an adjunct comprising the polymer on an inorganic carrier.

* * * * *